US008141210B2

(12) United States Patent
Colorado

(10) Patent No.: US 8,141,210 B2
(45) Date of Patent: Mar. 27, 2012

(54) TWO-STAGE QUICK RELEASE INTERCONNECT AND LOCKING DEVICE

(76) Inventor: Juancarlos Colorado, Petaluma, CA (US)

( * ) Notice: Subject to any disclaimer, the term of this patent is extended or adjusted under 35 U.S.C. 154(b) by 965 days.

(21) Appl. No.: 12/025,690

(22) Filed: Feb. 4, 2008

(65) Prior Publication Data

US 2008/0209698 A1 Sep. 4, 2008

Related U.S. Application Data

(60) Provisional application No. 60/888,041, filed on Feb. 2, 2007.

(51) Int. Cl.
*A45F 5/02* (2006.01)
*A45F 5/00* (2006.01)

(52) U.S. Cl. ..... 24/3.12; 24/578.13; 24/580.1; 24/580.11; 24/664; 224/197

(58) Field of Classification Search ..... 24/3.1, 24/3.12, 664, 666, 667, 669, 671, 578.13, 24/580.1, 580.11, 590.1; 224/197, 271, 269, 224/242, 665, 666
See application file for complete search history.

(56) References Cited

U.S. PATENT DOCUMENTS

| | | | | |
|---|---|---|---|---|
| 3,878,589 | A * | 4/1975 | Schaefer | 224/269 |
| 4,458,383 | A | 7/1984 | Hwang | |
| 4,587,818 | A | 5/1986 | Griffin | |
| 5,347,693 | A | 9/1994 | Otrusina | |
| 5,699,943 | A * | 12/1997 | Schaefer et al. | 224/242 |
| 5,799,847 | A * | 9/1998 | Sandor | 224/197 |
| 5,839,173 | A | 11/1998 | Otrusina | |
| 6,575,343 | B2 * | 6/2003 | Mossman | 224/197 |

* cited by examiner

*Primary Examiner* — Robert J Sandy
(74) *Attorney, Agent, or Firm* — Craig M. Stainbrook; Stainbrook & Stainbrook, LLP

(57) ABSTRACT

A quick release interconnect and locking device having a base plate with a post A circular and planar D-shaped disc is disposed on an end of the post. The apparatus has a female element with a contoured channel. A keeper plate with a vertical slot is placed over the contoured channel. A medial portion of the contoured channel includes an upper locking face terminating at a lower end in radius, such that when the D-disc is aligned parallel with the upper locking face, the D-disc may be translated downwardly until it encounters a locking portion, where it may again be rotated to bring the sliding face into alignment with a locking face and may then be translated downwardly to a semi-circular portion at the bottom of the contoured channel, where it may be rotated to lock it in the lower locking portion.

2 Claims, 7 Drawing Sheets

TWO-STAGE QUICK RELEASE INTERCONNECT AND LOCKING DEVICE

CROSS REFERENCES TO RELATED APPLICATIONS

The present application claims the benefit of U.S. Provisional Patent Application Ser. No. 60/888,041, filed Feb. 2, 2007 (Feb. 2, 2007).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to quick release connectors, and more particularly to a quick release connector providing a reversible attachment means between two apparatus by use a two-stage locking and release mechanism activated by rotation about an axis.

2. Discussion of Related Art Including Information Disclosed Under 37 CFR §§1.97, 1.98

Releasable connecting apparatus are well known. These devices range from simple mechanisms for clipping keys to a belt, as an example, to more complex devices comprising the use of male and female members that engage in complex ways to provide a reversible means for securing objects. At present, we are witnessing very rapid development in the kinds and quality of portable media devices offered in the market place (such things as cell phones, multimedia playback devices, and the like). There is a correspondingly growing need for secure means to carrying those devices on one's person, while maintaining the capability to quickly and easily reverse and release the attachment.

That same need is evident in the trades, as well, where tools must be securely transported during the course of work while remaining available for use at a moment's notice. This is especially true in the case of tools used for search and rescue, which must be carried into tight spaces while allowing mobility of the tool and a quick release mechanism for access to the tool. A practical example of this need is illustrated in the firefighting profession. Firemen must transport a large tool such as an axe through close quarters, in a secure fashion, but still have immediate access to the tool.

Some notable prior art devices are shown in the following United States patents:

U.S. Pat. No. 4,458,383, to Hwang, describes a safety guard device for a wallet utilizing a male vertical post that penetrates the outer edge of the wallet, and is received by a female lock base. The lock base is inserted through the upper portion of a trouser pocket. The connection is reversed by depressing a button on the reverse side of the female lock base.

U.S. Pat. No. 4,587,818, to Griffin, discloses a simple retaining clip for a key ring that utilizes a reverse curved retainer defining a receiving space for the key ring. The curved retainer is mounted on a belt through the use of base clip.

U.S. Pat. No. 5,347,693, to Otrusina, teaches a quick-release connecting apparatus for detachably interconnecting two objects having male and female structures, respectively, attached to the objects. The female structure has a generally U-shaped receptacle which opens at a peripheral edge; the male structure has a stud with a part-circular head at its distal end with a straight side dimensioned to be received in the female receptacle from its open end and is rotatable about the axis of the stud while disposed in the receptacle. A retaining prong unitary with the female structure is flexibly and resiliently movable between a locking position projecting into the entrance of the receptacle and a release position out of the entrance. The stud head moves the retaining member out of the way on insertion into the receptacle to permit insertion in any orientation, but the retaining prong prevents removal of the head from the receptacle except when it is in a single orientation wherein the straight side faces the pawl. A finger integral with the female structure projects into the receptacle for resilient engagement with the head to inhibit rotation of the head while in the receptacle A prior patent Otrusina, U.S. Pat. No. 5,839,173, shows a connecting apparatus for detachably connecting male and female elements attached to respective structures. The female structure has spaced-apart parallel planar walls defining a receptacle, and one wall has an aperture defining an entrance. A flexible cam is laterally offset to one side of the entrance and is integral with the one wall and inclined out of the plane of the wall toward the other wall. The male structure includes a stud with a part-circular head to pass through the entrance so that, in one rotational orientation of the head, it will clear the cam portion to permit free passage into and out of the receptacle. In all other rotational orientations the head will engage the cam portion, flexing it to permit movement of the head into the receptacle, but wedging against it to inhibit movement out of the receptacle.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The two-stage quick release interconnect and locking device of the present invention is a novel improvement over the prior art in providing a new means for reversibly attaching objects. None of the prior art teaches a two-stage mechanism for the reversible attachment and locking of objects, while also allowing rotation of the objects with respect to each other along an axis. The rotation along an axis is also utilized as the method for accomplishing unlocking and disconnection of the objects interconnected by the two-stage quick release interconnect and locking device.

The present invention does not utilize a pawl or a flexible resilient cam to achieve the interconnection and locking together of objects. Instead, the inventive apparatus employs a uniquely shaped female receptacle that receives a male structure only in specific rotational orientations.

Accordingly, the present invention comprises a flat, essentially rectangular male base plate affixed to an object, such as a tool, container or electronic device. The means by which the male base plate is attached to the object is variable and suited to the type of object to be used. Thus, it can include a weld, an adhesive, rivets, hook and loop fabric, and so forth, the particular means tailored to the weight and structure of the object and the degree of security desired.

A cylindrical male post having a central axis is affixed centrally to the male base plate and extends perpendicular to the plane of the male base plate. The cylindrical male post terminates at its distal end in a partly circular disc (referred to herein as a "D-disc"), which shares an axis with the cylindrical male post. The D-disc has a diameter larger than that of the cylindrical male post and is truncated on one end to define a straight edge, forming a "D" shape.

Next, the apparatus includes an essentially rectangular, female base plate having a front face, a back, a top edge, a bottom edge, a left side and a right side, and has a central channel with a left side and a right side commencing at the top edge of the female base plate and terminating immediately above the bottom of the female base plate. The channel is shaped to accept the D-disc in a specific orientation in two stops. The central channel is composed of three functional portions: the initial orifice, the central stop, and the final stop.

The central channel initial orifice has the shape of an offset funnel designed to aid in guiding and placement of the D-disc into the central channel in an orientation that will accept the D-disc. The left side of the initial orifice has a short angular entry leg, while the right side of the initial orifice has a long angular entry leg. The initial orifice leads into the channel central stop of the central channel which has a width sufficient to allow the D-disc to enter the central stop only in an orientation in which the straight edge of the D-disc is in a vertical position, with the straight edge to the right. The central stop is defined by a left side that extends from the short angular entry leg vertically and then curves inwardly in a radius similar to that of the D-disc at approximately the horizontal midline of the female base plate, and a right side that extends from the long angular entry leg vertically, then curving outwardly in a radius similar to that of the D-disc. The inward curve of the left side of the central stop and the outward curve of the right side of the central stop define space in which the D-disc can rest and rotate freely about its axis.

The channel continues vertically from the central stop to the final stop. The final stop is defined by a left side that extends vertically from the inward curve of the central stop, then curves outwardly in a circular manner to define the bottom of the final stop and the central channel. The right side of the final stop extends vertically from the outward curve of the right side of the central stop and joins the bottom of the final stop to define a semi-circular space of similar circumference as the D-disc.

Next, a flat keeper plate having a top edge, a bottom edge, and assuming the same essentially rectangular dimension as the female base plate, is attached in a coplanar orientation to the front face of the female base plate by rivets, welds or an adhesive. The keeper plate has a central longitudinal slot commencing in a V-shape on the keeper plate top edge and continuing longitudinally at a slightly larger diameter than the cylindrical male post, and terminating prior to the bottom edge of the keeper plate. The attachment of the keeper plate to the female base plate over the central channel defines a female aperture, within which the D-disc travels.

The D-disc enters the female aperture with its straight edge to the right through the initial orifice of the central channel to the central stop. Once the D-disc enters the central stop, it may rotate freely, and it may be removed from the female aperture by pulling the D-disc vertically. If a user wishes to engage the D-disc in a locked position, the D-disc enters the female aperture with the straight edge to the right through the initial orifice of the central channel to the central stop, and it is then rotated 180 degrees to allow the D-disc to assume the proper orientation to enter the final stop. Now the D-disc may rotate freely on its axis. This is called the "locked" position. To remove the D-disc from the final stop, the D-disc must be rotated 180 degrees to assume the proper orientation to exit the final stop.

Two identical belt plates are affixed to the female base plate back in a vertical orientation to form a channel through which a belt may be threaded to secure the female base plate to one's person.

There has thus been broadly outlined the more important features of the invention in order that the detailed description that follows may be better understood, and in order that the present contribution to the art may be better appreciated. Additional objects, advantages and novel features of the invention will be set forth in part in the description as follows, and in part will become apparent to those skilled in the art upon examination of the following. Furthermore, such objects, advantages and features may be learned by practice of the invention, or may be realized and attained by means of the instrumentalities and combinations particularly pointed out in the appended claims.

Still other objects and advantages of the present invention will become readily apparent to those skilled in this art from the following detailed description, which shows and describes only the preferred embodiments of the invention, simply by way of illustration of the best mode now contemplated of carrying out the invention. As will be realized, the invention is capable of modification in various obvious respects without departing from the invention. Accordingly, the drawings and description of the preferred embodiment are to be regarded as illustrative in nature, and not as restrictive.

BRIEF DESCRIPTION OF THE SEVERAL VIEWS OF THE DRAWINGS

The invention will be better understood and objects other than those set forth above will become apparent when consideration is given to the following detailed description of the best mode of practicing the invention. Such description makes reference to the annexed drawings wherein.

DETAILED DESCRIPTION OF THE INVENTION

Figure 1:
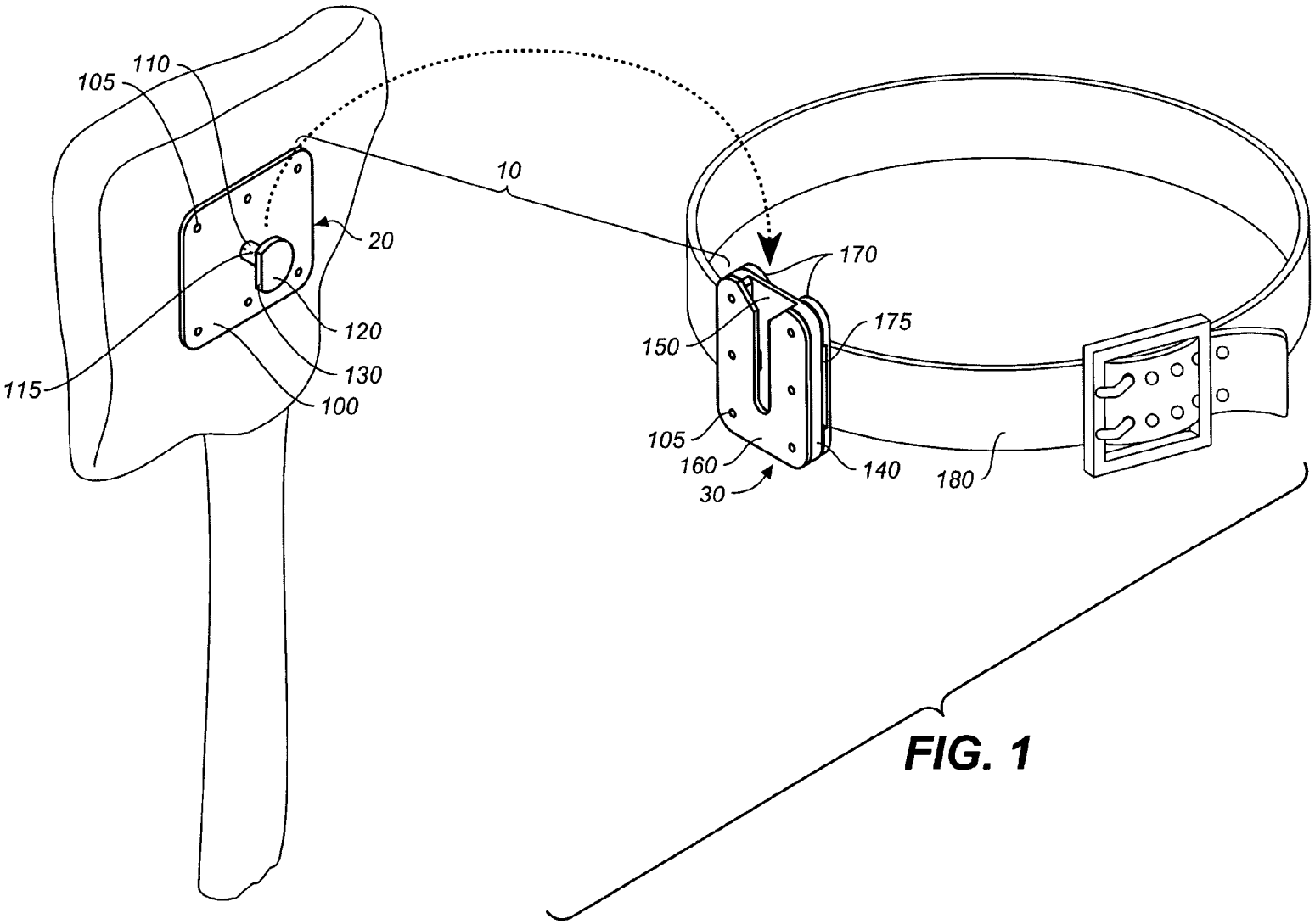
FIG. 1 is perspective view of the present invention showing a male base plate attached to an axe sheath and a female base plate attached to a belt.
Figure 1B:
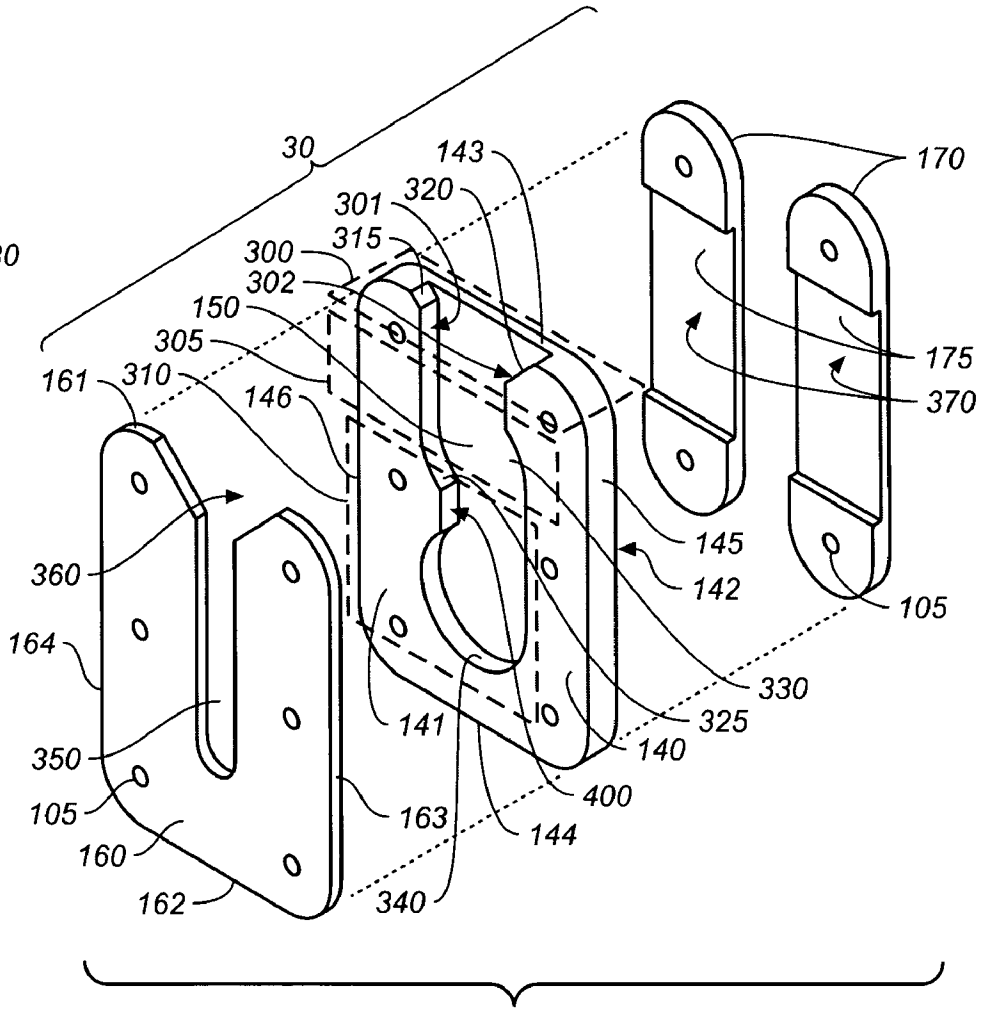
FIG. 1B is an exploded perspective view of the female base plate, keeper plate and belt plates of the two-stage quick release interconnect and locking device of the present invention.

Referring to FIGS. 1 through 5B, wherein like reference numerals refer to like components in the various views, there is illustrated therein a new and improved two-stage quick release interconnect and locking device, generally denominated 10 herein.

Figure 3:
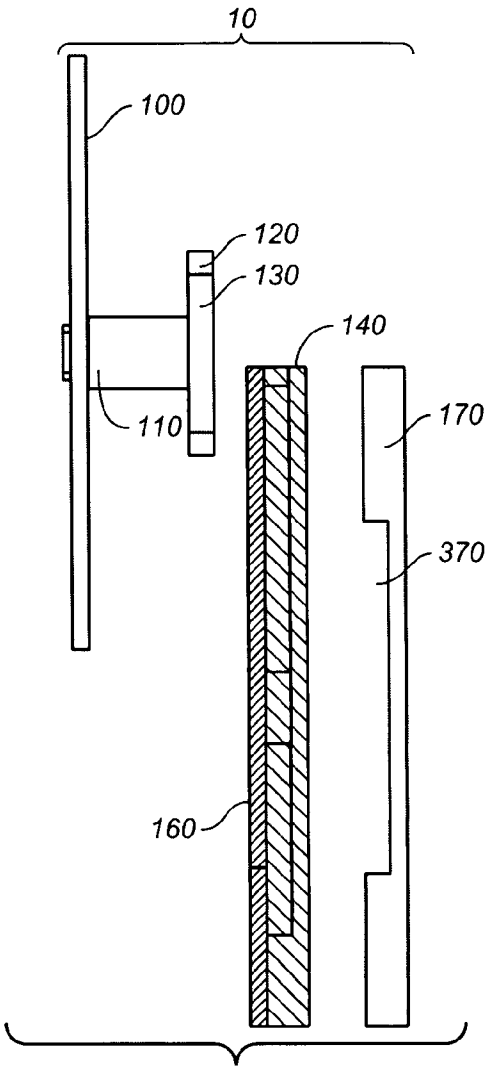
FIG. 3 is an exploded and partial cross-sectional side view in elevation thereof.
Figure 2:
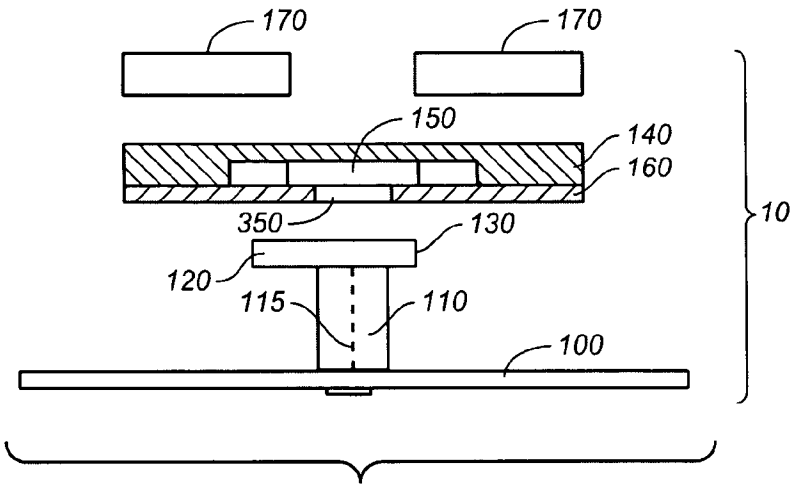
FIG. 2 is an exploded and partial cross-sectional top plan view thereof.

FIGS. 1-3 illustrate a first preferred embodiment of the inventive apparatus, showing the two-stage quick release interconnect and locking device 10 in a detached configuration. This view shows that the apparatus first includes a male element 20, which generally comprises a flat, essentially rectangular male base plate 100 affixed to a tool or tool sheath with rivets. A substantially cylindrical male post 110 includes a central axis 115 and is affixed at its proximal or first end in a generally central position on a planar side of the male base plate 100. The cylindrical male post extends generally normal or perpendicular to the planar side of the male base plate 100. The cylindrical male post 110 terminates at its distal or second end in a partly circular disc (D-disc) 120, and has a geometrical center generally disposed on the axis of the cylindrical male post 110. The D-disc 120 has a diameter larger than that of the cylindrical male post 110 and is truncated through a chord of the disc to define a straight sliding face or edge 130, thereby forming a "D" shaped plate, or D-disc.

Next, the two-stage quick release interconnect and locking device includes a female receiver element 30, which comprises an essentially rectangular, female base plate 140 having a front face 141, a back 142, a top 143, a bottom 144, a left side 145, and a right side 146. It further includes a contoured central channel 150, having a left side 151 and a right side, the central channel commencing at the top 143 of the female base plate 140, and terminating immediately above the bottom 144 of the female base plate 140. A flat keeper plate 160 having a top edge 161, a bottom edge 162, a left side 163, and a right side 164, has the same generally rectangular dimensions as the female base plate 140 and is securely attached in a coplanar orientation to the front face of the female base plate by rivets 105 or other attachment means.

Two substantially identical belt plates 170, each having recesses or channel portions 175 are affixed to the back 142 of the female base plate 140 in a generally vertical orientation such that when attached to the back of the female base plate, a channel 370 is thereby formed through which a belt 180 may be inserted. The belt may then be worn around the waist of a user to secure the female base plate to one's person.

Figure 1A:
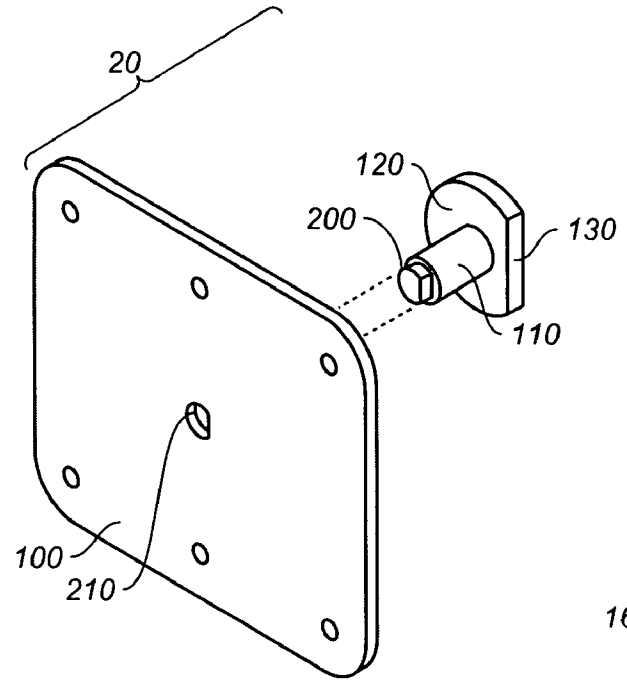
FIG. 1A is an exploded perspective view of the male base plate and cylindrical male post of the two-stage quick release interconnect and locking device of the present invention.

Referring now particularly to FIGS. 1A, 2, and 3, there is shown detail of the male element 20, which includes a substantially planar base plate 100 and cylindrical male post 110 disposed generally normal to the plane of the base plate. In this view the cylindrical male post has been detached from the base plate. Also depicted is D-disc 120, which has a diameter larger than that of the cylindrical male post 110 and is truncated through a chord to define a straight edge 130. The cylindrical male post 110 terminates axially with a D-shaped attachment stub 200 which attachably mates with a D-shaped orifice 210, preferably disposed generally at the geometrical center of the male base plate 100.

Referring next particularly to FIGS. 1B, 2, 3, and 4A, there is shown detail of the female receiver element 30. These views show that the female receiver element includes a female base plate 140, a keeper plate 160, and belt plates 170. As previously noted, the female base plate 140 includes a front face 141, a back 142, a top 143, a bottom 144, a left side 145, and a right side 146. Further, it includes a contoured central channel 150, having a left side 151, and a right side 152, the channel commencing at the top 143 of the female base plate 140, and terminating slightly above the bottom 144 of the female base plate 140. The central channel 150 includes three portions or functional areas, including an upper initial orifice portion 300, a central or medial stop portion 305, and a final stop or locking portion 310.

The initial orifice portion 300 is an opening having the shape of an offset funnel. The right side 301 of the initial orifice portion 300 has a short angular entry leg 315, while the left side 302 of the initial orifice portion 300 has a long angular entry leg 320. The initial orifice portion leads into the central stop portion 305 of the central channel 150. The central stop 305 is defined by a right side which extends from the short angular entry leg 315 vertically and then curves inwardly to form a central stop truncated inward radius 325, and a left side which extends from the long angular entry leg 320 vertically, and then curves outwardly to form a central stop truncated outward radius 330.

The central channel 150 continues vertically from the central stop 305 to the locking stop, or final stop 310. The final stop 310 is defined by a right side that extends vertically from the central stop truncated inward radius 325, then curves outwardly in a circular manner to define the semicircular bottom of the final stop 340. The left side of the final stop 310 extends vertically from the central stop truncated outward radius 330 and joins the semicircular bottom of the final stop 340.

The keeper plate 160 has a top 161 and a bottom 162, and has essentially the same outer or peripheral dimensions as the female base plate 140. It is securely attached in a coplanar orientation to the front face 141 of the female base plate 140 by rivets 105. The keeper plate has a central longitudinal slot 350 initiating in a V-shaped entry 360 formed in the keeper plate top 161, continuing longitudinally, and terminating prior to the bottom 162 of the keeper plate 160.

Figures 4A, 4B, 4C:
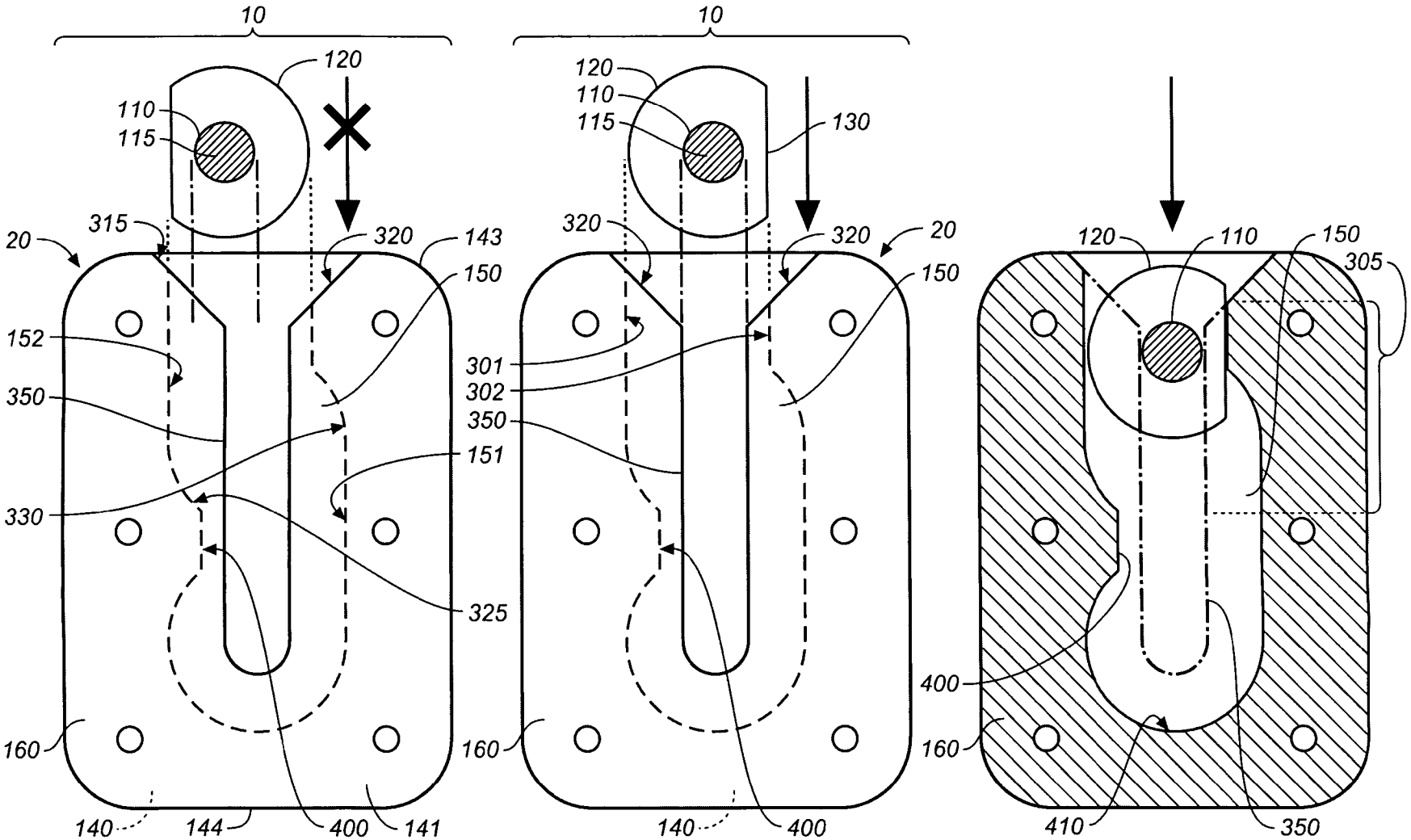
FIG. 4A is front view in elevation of the female base plate and cross-sectional front view of the male cylindrical post and D-disk, showing an orientation of the D-disk which is not properly aligned for insertion into the channel of the female base plate.
FIG. 4B is a similar front view in elevation thereof, wherein the D-disk of the male base plate is properly aligned and oriented for insertion into the channel of the female base plate.
FIG. 4C is a cross-sectional front view in elevation of the female base plate and male cylindrical post showing the initial insertion of the D-disc into the central channel of the female base plate.

FIGS. 4A and 4B are partial cross-sectional front views in elevation of the two stage quick release interconnect and locking device 10 showing the keeper plate installed on the female base plate and the male element poised for insertion into the channel of the female receiver element. FIGS. 4C through 4H are cross-sectional front views in elevation illustrating insertion and manipulation of the male element in the female receiver element to effect full insertion and locking. FIG. 4A shows an ineffective alignment and orientation of the D-disc 120 relative to the central channel 150 of the female base plate 140, disposed immediately behind the keeper plate 160. The central axis 115 of the cylindrical male post 110 is not centered in the longitudinal slot 350 of the keeper plate 160, thus precluding insertion into the central channel 150 any deeper than the angular entry legs 320 of the keeper plate.

By contrast, FIG. 4B shows a correct orientation of the D-disc 120 relative to the central channel 150 of the female base plate 140 so as to permit insertion into the female receiver element 20. In this instance, the central axis 115 of the cylindrical male post 110 is centered in the longitudinal slot 350 of the keeper plate 160, thus allowing the straight edge (sliding face) 130 of the D-disc 120 to enter and pass along the left side 302 of the initial orifice portion 300 of the central channel 150.

Next, referring to FIG. 4C, the male cylindrical post 110 is centered in the longitudinal slot 350 of the keeper plate 160, allowing the D-disc 120 to enter the central stop portion 305 of the central channel 150. The straight edge (sliding face) 130 of the D-disc 120 is parallel with the vertical plane of the central stop portion 305. It will be appreciated, therefore, that the left side 302 of the initial orifice portion 300 functions as an upper locking face.

Figures 4D, 4E, 4F:
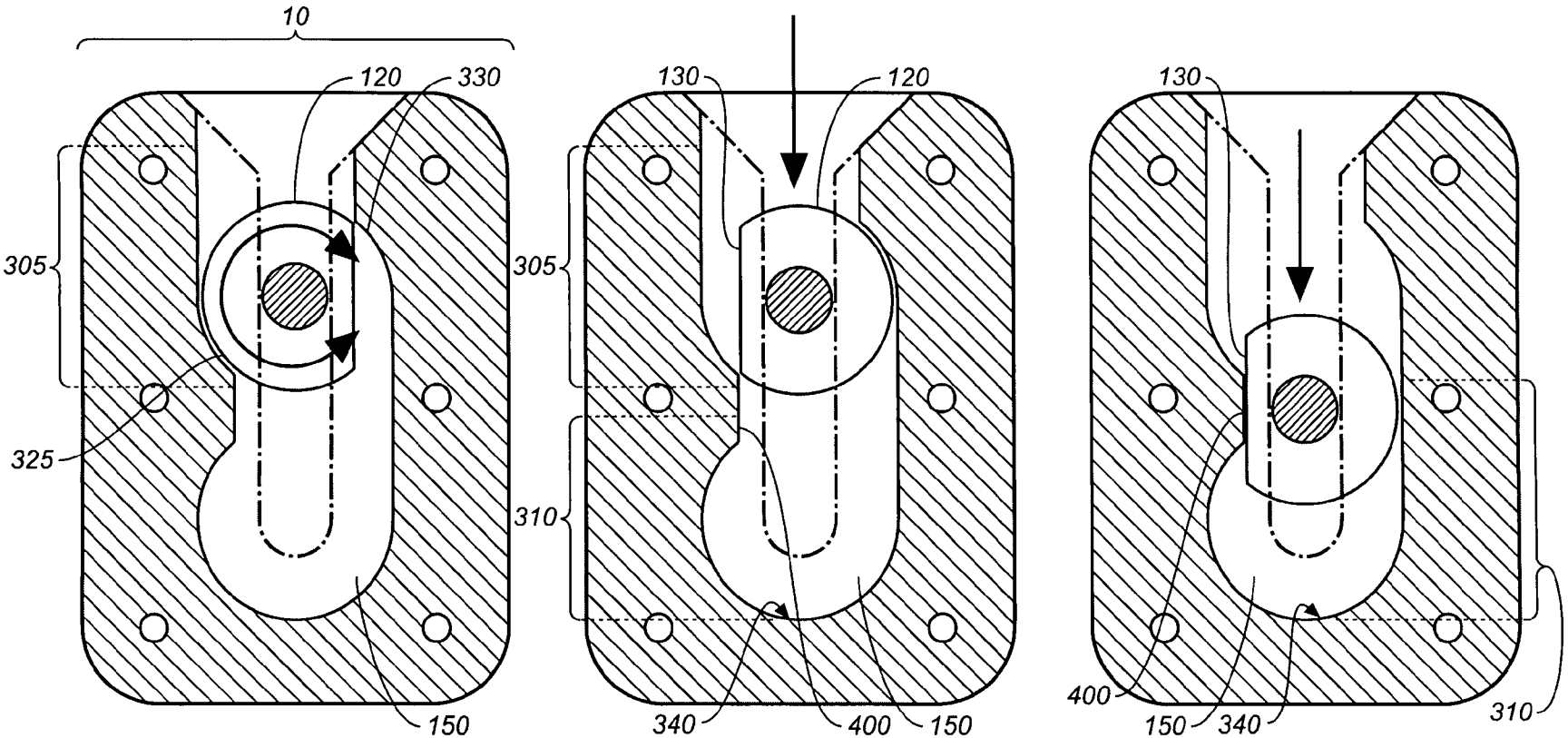
FIG. 4D is a cross-sectional front view in elevation illustrating the orientation and rotation of the D-disc in the central stop portion of the central channel of the female base plate.
FIG. 4E is a cross-sectional front view in elevation showing the orientation of the D-disc necessary to enter the final stop portion of the central channel of the female base plate.
FIG. 4F is a cross-sectional front view in elevation illustrating the D-disc entering the final stop portion of the central channel of the female base plate.

FIG. 4D shows how the D-disc 120, after passing by the upper locking face 302, may be rotated in an upper or first rotating space in the central stop portion 305 of the central channel 150, which upper or first rotating space is defined by that area between the central stop truncated inward radius 325 and the central stop truncated outward radius 330. When the D-disc is rotated 180 degrees within the first rotating space, the sliding face 130 is brought into alignment with a lower locking face 400. This allows the male cylindrical post and D-disc to be inserted more deeply into the central channel after insertion in the initial orifice portion.

FIG. 4E again shows the orientation of the D-disc 120 in the central stop portion 305 of the central channel 150 after it has been rotated to facilitate yet further and deeper insertion into the central channel. The rounded circumferential portion of the D-disc 120 is in contact with the central stop truncated outward radius 330, while the straight edge 130 of the sliding face of the D-disc 120 is immediately above and generally aligned parallel with the right vertical side of the lower locking face 400 of the final stop portion 310. Again, in this orientation it will be capable of being lowered further into the contoured channel.

Referring next to FIG. 4F, the straight edge 130 of the D-disc 120 is generally parallel to and therefore allowed to pass by the lower locking face 400 of the final stop portion 310 of the central channel 150, which allows the D-disc to translate fully down into the semicircular bottom 340 of the final stop portion, which functions as a second or lower rotating space in which the D-disc is free to be rotated by a user.

Figure 4H:
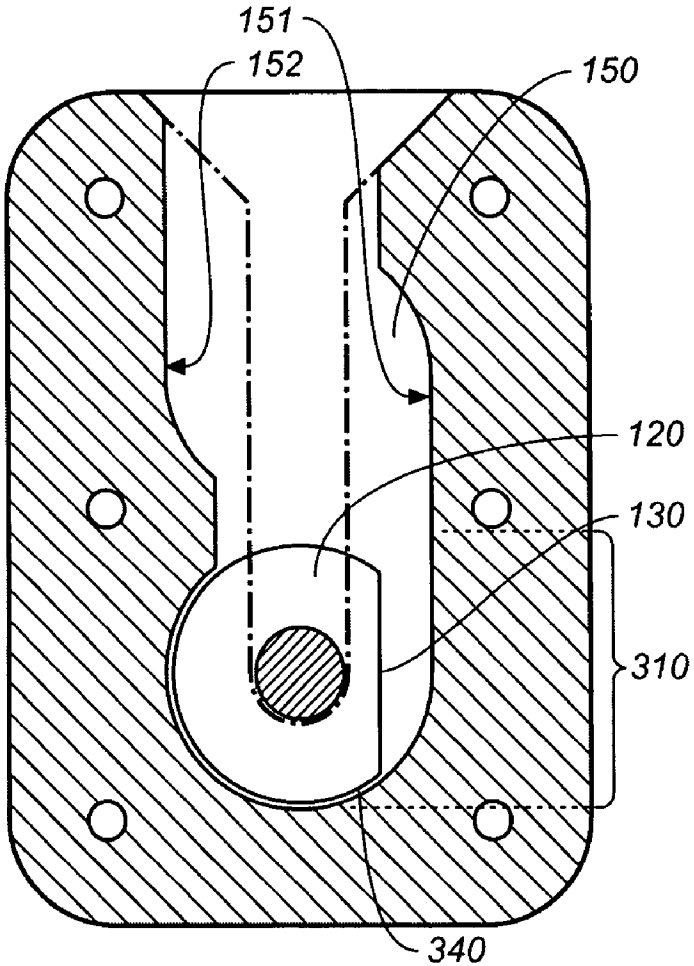
FIG. 4H is a cross-sectional front view in elevation showing the orientation of the D-disc in the locked position in final stop portion of the central channel of the female base plate.
Figure 4G:
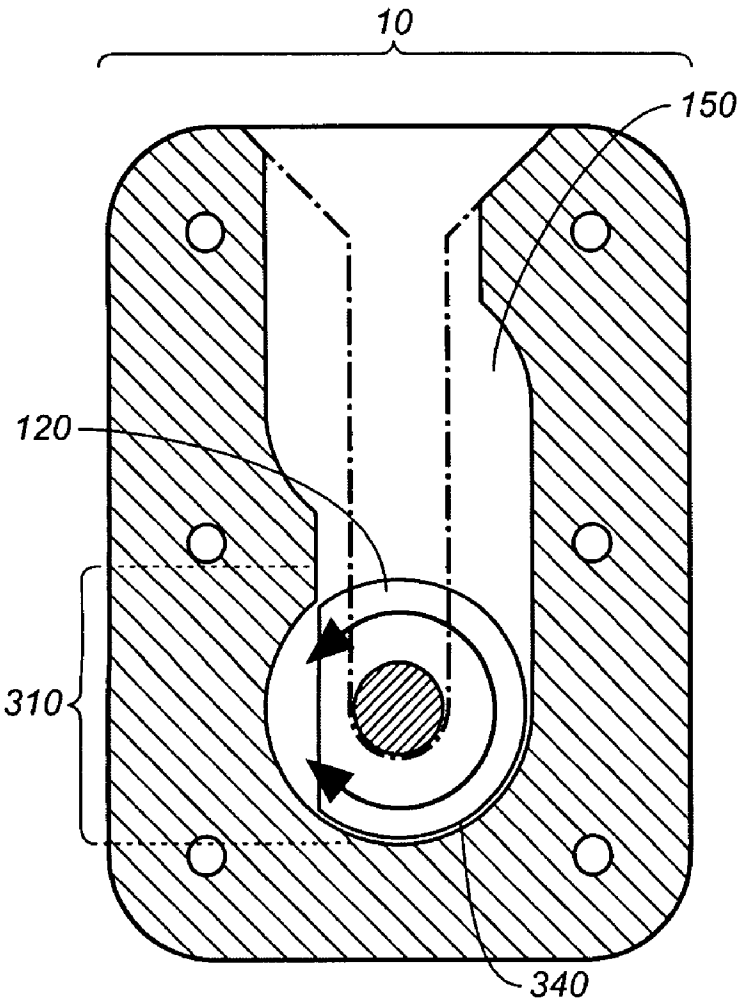
FIG. 4G is a cross-sectional front view in elevation illustrating the rotation of the D-disc possible in the final stop portion of the central channel of the female base plate.

FIG. 4G shows the free rotation of the D-disc 120 in the final stop 310 area of the central channel 150. The D-disc is in contact with the semicircular bottom 340 of the final stop portion 310.

FIG. 4H shows the D-disc 120 in the final stop portion 310 of the central channel 150 in a "locked" position. The D-disc is in general contact with the semicircular bottom 340 of the final stop 310, and the straight edge 130 of the D-disc 120 is rotated 180 degrees and faces the left side 151 in the central channel 150.

In the most essential terms, it will be seen that the upper locking face 302 terminates at its lower end in an outward radius, while the right side of the central stop portion terminates in an inward radius that complements the outward radius so as to capture and hold the D-disc in the central stop portion until the D-disc is rotated and thereby reoriented within the central stop portion to pass by the lower locking face. The lower locking face 400 terminates at its lower end by an outward radius contiguous with the semi-circular bottom 340 of the final stop portion, while the left side of the contoured channel (now in the final stop portion) curves inwardly to form the semi-circular bottom itself. This contouring is such that when the D-disc is passed by the lower locking face 400, the D-disc may be rotated any amount within the final stop portion so as to take the sliding face 130 out of alignment with the lower locking face and to prevent egress from the final stop portion of the central channel.

It is most essential terms, then, the present invention may be considered as 1. A quick release interconnect and locking device, comprising a male element having a base plate with at least one substantially planar side, a post having a proximal end attached to said base plate such that said post is generally normal to said planar side, a generally circular planar D-disc disposed on a distal end of said post, said D-disc having a diameter greater than said post and a generally flat sliding face defined by a cord truncating a portion of said circular planar plate; a female element having a contoured channel with an upper portion, a medial portion, and a lower locking portion, and retention means disposed over said channel and having a longitudinally disposed slot for retaining said D-disc in said contoured channel while also allowing slidable insertion of said post and said D-disc into said contoured channel from said upper portion to said lower locking portion; and means for connecting either of said male element or said female element to an article.

Figure 5B:
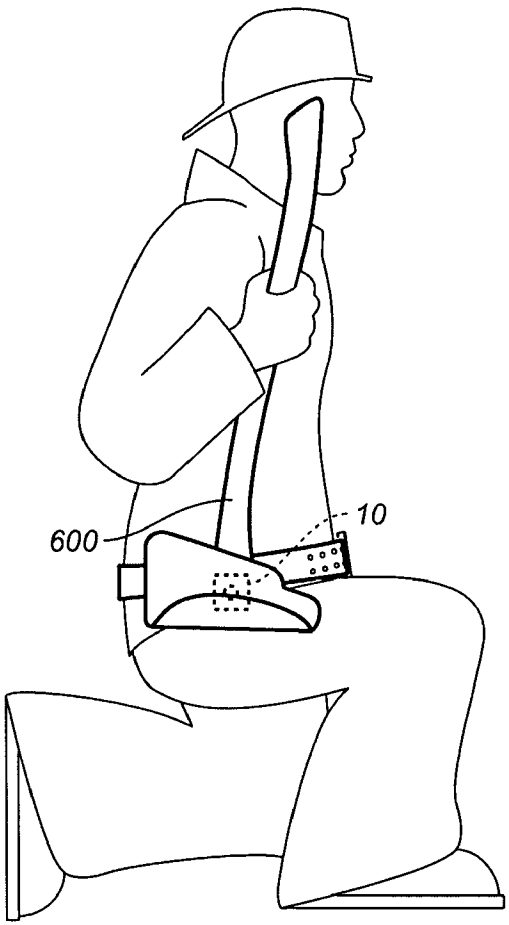
FIG. 5B is a schematic view showing depicting the fireman having rotated the axe 180 degrees for release and removal from the female base plate and belt.
Figure 5A:
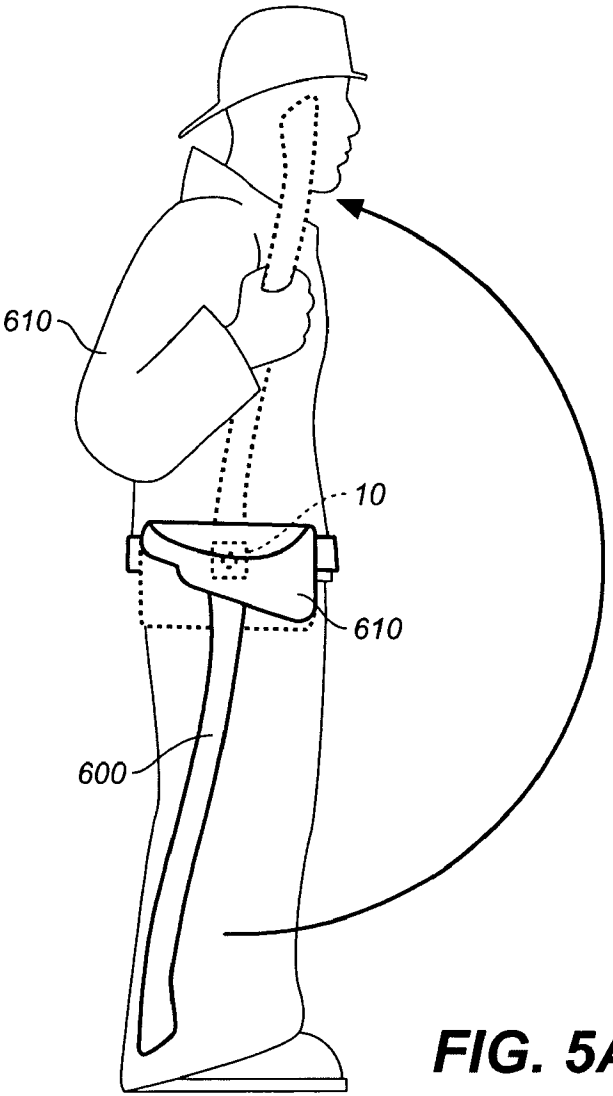
FIG. 5A is a schematic view showing the rotation pattern for a fireman having an axe in a sheath which is attached to the male base plate and belt attached to the female base plate of the two-stage quick release interconnect and locking device of the present invention.

FIG. 5A is a schematic view depicting a firefighter 610 rotating an axe 600 having a sheath attached to the two-stage quick release interconnect and locking device (the female receiver element, not shown, is attached to the firefighter's belt. FIG. 5B shows the firefighter 610 having used the axe handle to rotate the axe 600 to bring the male element into orientation to permit removal from the female element of the two-stage quick release interconnect and locking device.

Having fully described several embodiments of the present invention, many other equivalents and alternative embodiments will be apparent to those skilled in the art. These and other equivalents and alternatives are intended to be included within the scope of the present invention. For instance, it will be appreciated that while the female and male elements are shown attached to a belt and axe sheath, respectively, the list of particular articles to which they may be attached is effectively endless. Accordingly, first and second articles of many kinds may be selectively connected and locked to one another using the interconnect and locking apparatus of the present invention.

What is claimed as invention is:

1. A quick release interconnect and locking device, comprising:

a male element having a base plate with at least one substantially planar side, a post having a proximal end attached to said base plate such that said post is generally normal to said planar side, a generally circular planar D-disc disposed on a distal end of said post, said D-disc having a diameter greater than said post and a generally flat sliding face defined by a cord truncating a portion of said circular planar plate;

a female element having a contoured channel with an upper portion, a medial portion, and a lower locking portion, and retention means disposed over said channel and having a longitudinally disposed slot for retaining said D-disc in said contoured channel while also allowing slidable insertion of said post and said D-disc into said contoured channel from said upper portion to said lower locking portion;

means for connecting either of said male element or said female element to an article; and wherein said medial portion of said contoured channel includes a right side and a left side, said left side having a substantially straight upper locking face that terminates at a lower end in an outward radius, such that when said sliding face of said D-disc is aligned generally parallel with said upper locking face, said D-disc may be translated downwardly into said contoured channel until said sliding face fully passes by said upper locking face, and after passing said upper locking face said D-disc may be freely rotated within said medial portion of said contoured channel.

2. The apparatus of claim 1, wherein said lower locking portion includes a right side and a left side, said right side including a substantially straight lower locking face that terminates at a lower end in an outward radius, such that when said sliding face of said D-disc is aligned generally parallel with said lower locking face, said D-disc may be translated downwardly into the lower locking portion of said contoured channel until said sliding face fully passes by said lower locking face, and after passing said lower locking face said D-disc may be freely rotated within said lower locking portion of said contoured channel so as to allow selection locking or selective release of said D-disc from said lower locking portion.

* * * * *